US009171417B2

(12) United States Patent
Gagner et al.

(10) Patent No.: US 9,171,417 B2
(45) Date of Patent: Oct. 27, 2015

(54) FAULT TOLERANT GAMING SYSTEMS

(75) Inventors: Mark B. Gagner, West Chicago, IL (US); Robertus A. Kloes, London (GB); Michael R. Bytnar, Naperville, IL (US); Matthew Huy-Gia Phan, Las Vegas, NV (US); Jorge Luis Shimabukuro, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 1902 days.

(21) Appl. No.: 11/995,046

(22) PCT Filed: Jul. 7, 2006

(86) PCT No.: PCT/US2006/026805

§ 371 (c)(1),
(2), (4) Date: Jun. 24, 2008

(87) PCT Pub. No.: WO2007/008845

PCT Pub. Date: Jan. 18, 2007

(65) Prior Publication Data

US 2009/0042640 A1 Feb. 12, 2009

Related U.S. Application Data

(60) Provisional application No. 60/697,653, filed on Jul. 8, 2005.

(51) Int. Cl.

| | |
|---|---|
| ***G07F 17/00*** | (2006.01) |
| ***G07F 17/32*** | (2006.01) |
| ***G07F 17/34*** | (2006.01) |

(52) U.S. Cl.
CPC ..... *G07F 17/32* (2013.01); *G07F 17/34* (2013.01)

(58) Field of Classification Search
CPC ..... G07F 17/32
USPC ..... 463/24
See application file for complete search history.

(56) References Cited

U.S. PATENT DOCUMENTS

| | | | | |
|---|---|---|---|---|
| 5,611,730 | A * | 3/1997 | Weiss | 463/20 |
| 5,971,851 | A * | 10/1999 | Pascal et al. | 463/24 |
| 6,251,014 | B1 * | 6/2001 | Stockdale et al. | 463/16 |
| 6,594,774 | B1 | 7/2003 | Chapman et al. | |
| 6,855,058 | B2 | 2/2005 | Kubota et al. | |
| 6,862,688 | B2 | 3/2005 | Ochiai | |
| 6,899,627 | B2 * | 5/2005 | Lam et al. | 463/40 |
| 7,549,922 | B2 * | 6/2009 | Falvey et al. | 463/29 |

(Continued)

OTHER PUBLICATIONS

"International Search Report for Application No. PCT/US2006/026805, date mailed Feb. 21, 2007", 3 pgs.
"Written Opinion of the International Searching Authority for Application No. PCT/US2006/026805, date mailed Feb. 21, 2007", 7 pgs.

*Primary Examiner* — Reginald Renwick
(74) *Attorney, Agent, or Firm* — Nixon Peabody LLP

(57) ABSTRACT

Method and apparatus are provided wherein, in one example embodiment, a gaming machine includes a computing platform and a software program executing on the computing platform to provide a gaming experience to a user of the gaming machine, and there are provided one or more hardware or software components operative on the computing platform to detect faults occurring on the platform. At least one fault recovery software component is also operative on the gaming platform, and the fault recovery software component is adapted to operate in response to the detection of a fault.

21 Claims, 6 Drawing Sheets

(56) References Cited

U.S. PATENT DOCUMENTS

| | | | | |
|---|---|---|---|---|
| 8,876,597 | B2 * | 11/2014 | Blackburn et al. | 463/29 |
| 2003/0003997 | A1 | 1/2003 | Vuong et al. | |
| 2003/0014639 | A1 * | 1/2003 | Jackson et al. | 713/181 |
| 2004/0048669 | A1 * | 3/2004 | Rowe | 463/42 |
| 2004/0259633 | A1 * | 12/2004 | Gentles et al. | 463/29 |
| 2005/0055607 | A1 | 3/2005 | Czajkowski et al. | |
| 2006/0068867 | A1 * | 3/2006 | White et al. | 463/13 |

* cited by examiner

FAULT TOLERANT GAMING SYSTEMS

RELATED APPLICATIONS

This application is a U.S. National Stage Filing under 35 U.S.C. 371 from International Patent Application Serial No. PCT/US2006/026805, filed Jul. 7, 2006, and published on Jan. 18, 2007 as WO 2007/008845 A2, and republished on Jan. 18, 2007 as WO 2007/008845 A3, which claims the priority benefit of U.S. Provisional Application Ser. No. 60/697,653 filed Jul. 8, 2005, the contents of which are incorporated herein by reference.

TECHNICAL FIELD OF THE INVENTION

The inventive subject matter relates generally to the field of gaming, and more particularly to systems and methods for fault tolerant gaming systems.

COPYRIGHT

A portion of the disclosure of this patent document contains material to which the claim of copyright protection is made. The copyright owner has no objection to the facsimile reproduction by any person of the patent document or the patent disclosure, as it appears in the U.S. Patent and Trademark Office file or records, but reserves all other rights whatsoever. Copyright 2006, WMS Gaming, Inc.

BACKGROUND

Casino gaming machines should be reliable such that players do not inadvertently lose credits recorded on the machines or lose a winning outcome prior to the credits being awarded. For instance, if a slot machine fails in the course of a spin, the player may be suspicious that he or she had been denied a winning outcome due to the machine's failure. Or, if a machine failure results in a machine losing track of credits, the gaming establishment may be placed in a difficult position trying to determine how to compensate the player who has lost those credits. In addition, even if the failure of the machine does not result in any of the foregoing difficulties, the player's confidence in the machine may be eroded, and the player less likely to continue using that type of machine or indeed gambling at all.

DETAILED DESCRIPTION

In the following detailed description, reference is made to the accompanying drawings that form a part hereof, and in which are shown by way of illustration specific embodiments in which the inventive subject matter can be practiced. It is understood that other embodiments may be utilized and structural changes may be made without departing from the scope of the present invention. The leading digit(s) of reference numbers appearing in the Figures generally corresponds to the Figure number in which that component is first introduced, such that the same reference number is used throughout to refer to an identical component which appears in multiple Figures. Signals and connections may be referred to by the same reference number or label, and the actual meaning will be clear from its use in the context of the description.

Figure 1:
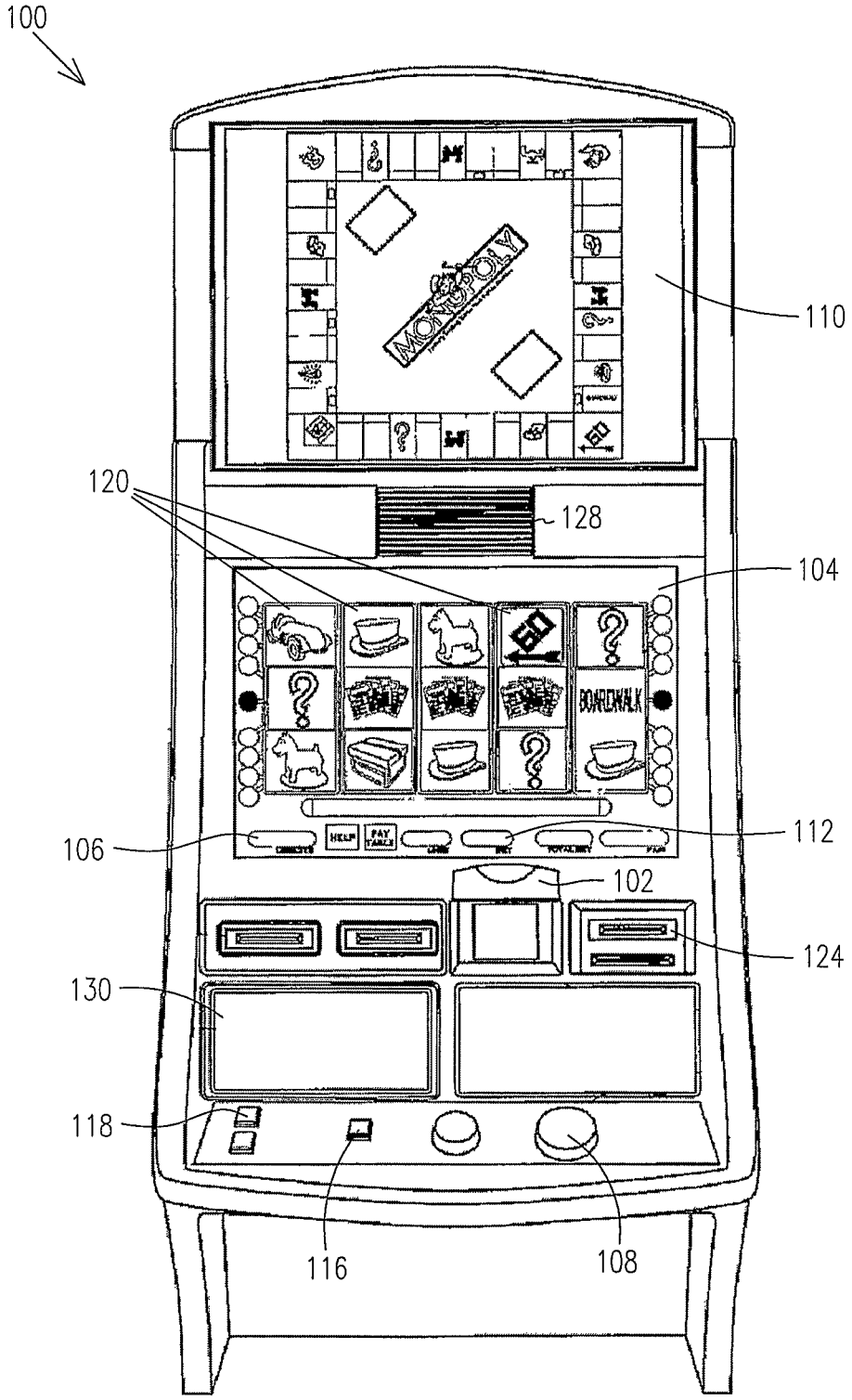
FIG. 1 illustrates an exemplary embodiment of a gaming machine apparatus suitable for use in the inventive subject matter disclosed herein.

FIG. 1 is a perspective view of a wagering game machine, according to exemplary embodiments of the inventive subject matter disclosed herein. As shown in FIG. 1, the wagering game machine 100 can be a computerized slot machine having the controls, displays, and features of a conventional slot machine. The wagering game machine 100 can be operated while players are standing or seated. Additionally, the wagering game machine 100 is preferably mounted on a stand (not shown). However, it should be appreciated that the wagering game machine 100 can be constructed as a pub-style tabletop game (not shown), which a player can operate while sitting. Furthermore, the wagering game machine 100 can be constructed with varying cabinet and display designs. The wagering game machine 100 can incorporate any primary game such as slots, poker, or keno, and additional bonus round games. The symbols and indicia used on and in the wagering game machine 100 can take mechanical, electrical, or video form.

As illustrated in FIG. 1, the wagering game machine 100 includes a coin slot 102 and bill acceptor 124. Players can place coins in the coin slot 102 and paper money or ticket vouchers in the bill acceptor 124. Other devices can be used for accepting payment. For example, credit/debit card readers/validators can be used for accepting payment. Additionally, the wagering game machine 100 can perform electronic funds transfers and financial transfers to procure monies from financial accounts. When a player inserts money in the wagering game machine 100, a number of credits corresponding to the amount deposited are shown in a credit display 106. After depositing the appropriate amount of money, a player can begin playing the game by pushing play button 108. The play button 108 can be any play activator used for starting a wagering game or sequence of events in the wagering game machine 100.

As also shown in FIG. 1, the wagering game machine 100 also includes a bet display 112 and a "bet one" button 116. The player places a bet by pushing the bet one button 116. The player can increase the bet by one credit each time the player pushes the bet one button 116. When the player pushes the bet one button 116, the number of credits shown in the credit display 106 decreases by one credit, while the number of credits shown in the bet display 112 increases by one credit.

A player may "cash out" by pressing a cash out button 118. When a player cashes out, the wagering game machine 100 dispenses a voucher or currency corresponding to the number of remaining credits. The wagering game machine 100 may employ other payout mechanisms such as credit slips (which are redeemable by a cashier) or electronically recordable cards (which track player credits), or electronic funds transfer.

The wagering game machine may also include a primary display unit 104 and a secondary display unit 110 (also known as a "top box"). The wagering game machine may also include an auxiliary video display 130. In one embodiment, the primary display unit 104 displays a plurality of video reels 120. According to embodiments of the invention, the display units 104 and 110 can include any visual representation or exhibition, including moving physical objects (e.g., mechanical reels and wheels), dynamic lighting, and video images. In one embodiment, each reel 120 includes a plurality of symbols such as bells, hearts, fruits, numbers, letters, bars or other images, which correspond to a theme associated with the wagering game machine 100. Furthermore, as shown in FIG. 1, the wagering game machine 100 includes a audio presentation unit 128. The audio presentation unit 128 can include audio speakers or other suitable sound projection devices.

Fault Tolerant Embodiments

Figure 2A:
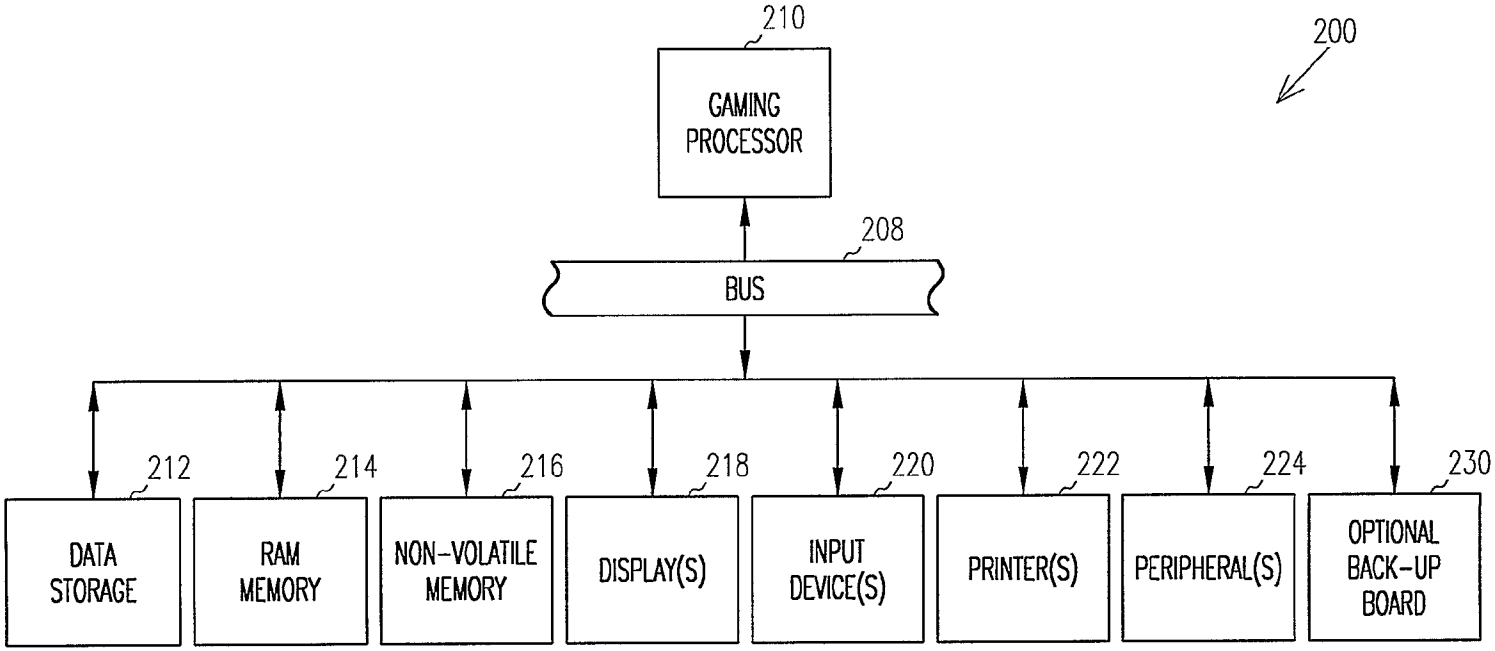
FIGS. 2A and 2B illustrate example embodiments of a gaming machine system according to the inventive subject matter disclosed herein.
Figure 2B:
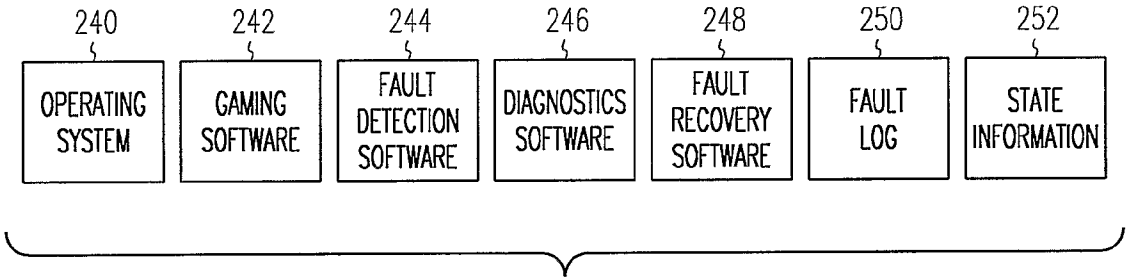

Referring now to FIGS. 2A and 2B, there is illustrated an example embodiment of a fault tolerant system 200 according to the inventive subject matter disclosed herein. System 200 includes a gaming processor 210 connected to a system bus 208. System 200 further includes the following components connected to bus 208: a data storage unit 212 (such as a hard drive or other magnetic media), random access memory (RAM) 214, non-volatile memory 216, one or more displays 218, one or more input devices 220, one or more printers 222, other peripherals 224, and an optional back-up board 230 that may include an auxiliary processor. As illustrated in FIG. 2B, the system 200 may further include an operating system 240, gaming software 242, fault detection or monitoring software 244, diagnostics software 246, and fault recovery software 248, fault logs 250 and system state data 252. The foregoing may be used to provide a fault tolerant gaming system for example as described below with respect to FIGS. 3-10.

Figure 3:
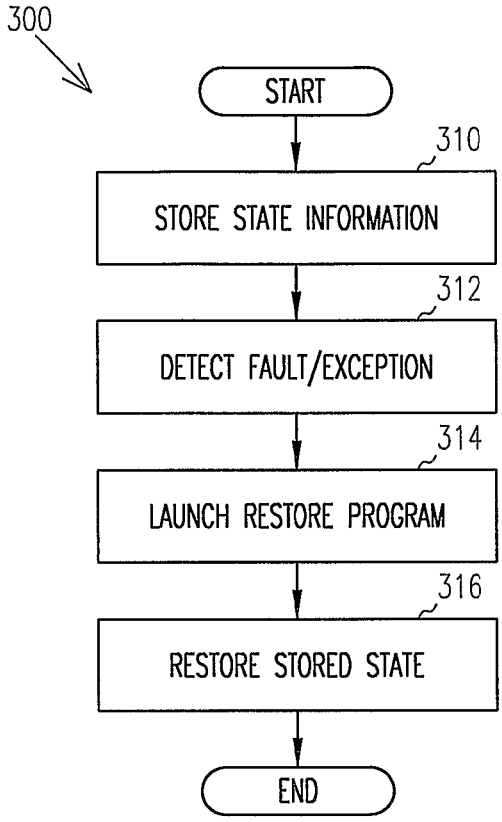
FIGS. 3 to 10 illustrate flow charts of various example embodiments of the inventive subject matter disclosed herein.

Referring now to FIG. 3 there is illustrated a method according to a first example embodiment of the inventive subject matter disclosed herein. According to embodiment 300, there is provided a fault tolerant gaming machine that provides for fault logging and fault recovery. According to one example embodiment, there is stored 310, at any point in time, in non-volatile memory, data representative of a system state, for example the state of the software and hardware of the gaming machine, such that the stored state may be restored 316 to the gaming machine if, for example, a fault is detected 312. Upon detection of a fault, a fault recovery program 314 is launched and restores the system to the stored state, and the system is restarted from the stored state. Accordingly the system may be restored to the last known stable configuration stored in a non-volatile memory. Alternatively, the last known state may be stored in another computing system and transferred to the gaming machine when restoration is desired. The state restored in 316 may not be the state stored in 310, since the state stored in 310 may be a fault/exception state.

According to another embodiment, the gaming system software may include an "undo" function that allows the software to undo previous actions until a stable or desired state is obtained. According to another example embodiment, the method includes collecting information from the system, such as from software or data loaded in memory or other storage and the status of hardware elements. The collected information may then be analyzed and used to recover to a desired state, for example to recover information regarding the number of credits that the machine had prior to experiencing the fault.

Figure 4:
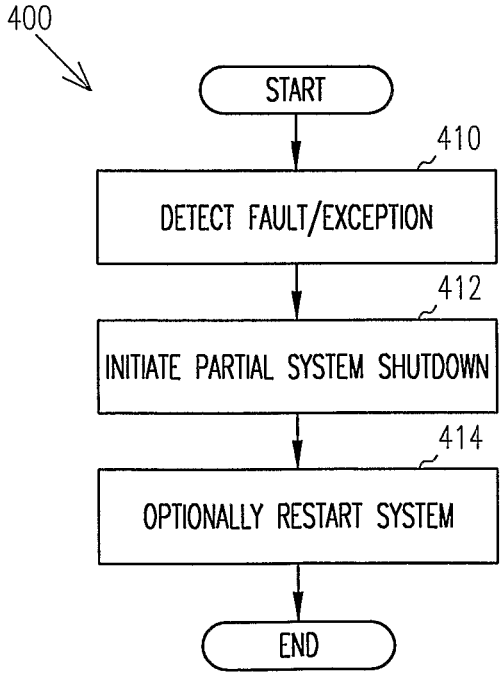

According to another example embodiment 400 illustrated in FIG. 4, there is provided, upon detection of a fault 410, for partial system shutdown 412 to stabilize the gaming system and preserve important information such as the number of credits on the machine or the amount of a win that occurs just prior to a fault but before credits for the win are applied or paid out. For example, such partial system shutdown may include terminating or suspending any process using a hardware component that has faulted, or using an operating system component that is in an inoperative or fault state. In another optional embodiment, the application running the gaming system may be restarted 414, but not the operating system or kernel, and key information such as credits or jackpot awards are stored in the operating system data and are recovered for use in restarting the application. Accordingly, the system provides for a partial and potentially more graceful partial system shutdown allowing for preserving critical data such as credits or payout information.

Figure 5:
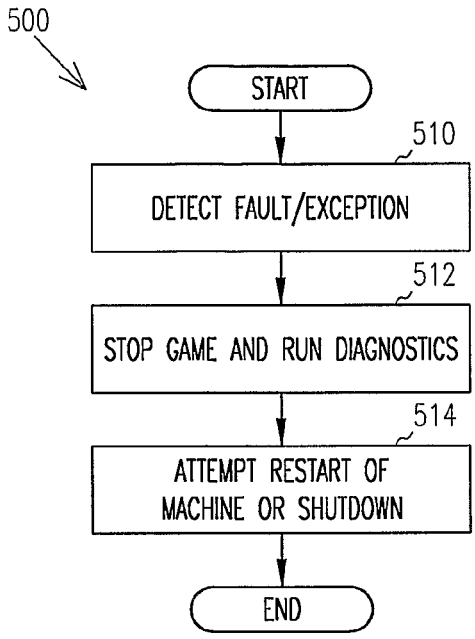

According to a still further embodiment 500 shown in FIG. 5, the system and method may monitor 510 for faults or exceptions, and in the event of an exception, stop the gaming application and run a self-diagnostic 512 to determine the nature of the error causing the exception. An attempt may then be made to correct the error and restart the application with the error corrected or shut it down 514. According to another embodiment, a self-diagnostic is run constantly on mode and application data dumped to a host system, and any errors detected cause the system to halt and take action to correct the error and optionally reboot.

Figure 6:
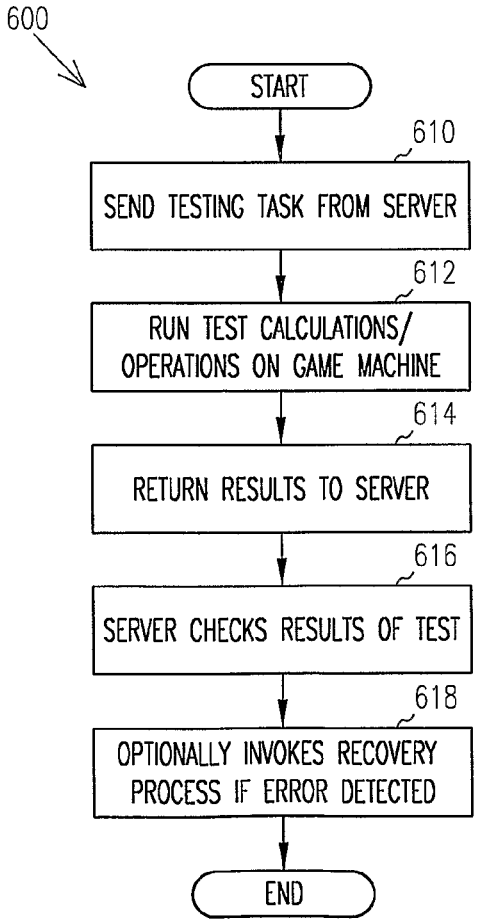

According to still another example embodiment 600 illustrated in FIG. 6, the worthiness and error condition of a gaming machine is tested 612 in response to test task or process sent 610 to the gaming machine from a server device. In such a system, for example, the server may send a data set and a request for calculations or other processing based on the data set, to the gaming machine to be tested. The gaming machine performs the requested calculations or processing, if capable, and returns 614 the results to the server. The server checks 616 to see if the resulting data matches the expected result, and if not invokes an error recovery process 618 for the gaming machine, such as saving off critical data or states, and restarting the machine to an error-free condition.

Figure 7:
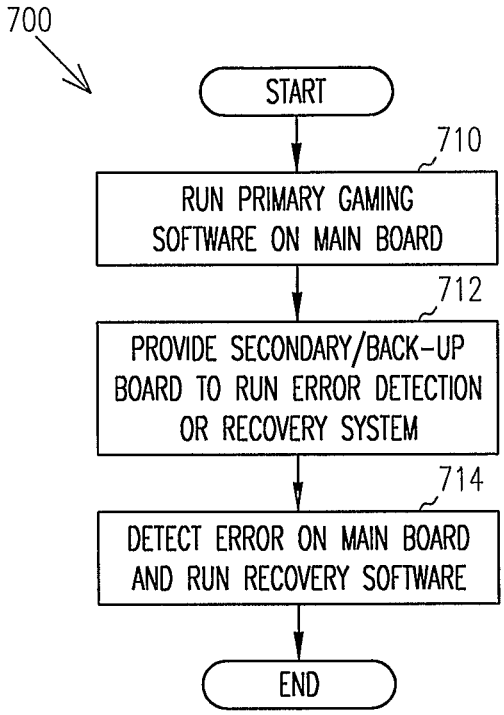

According to still another example embodiment 700 shown in FIG. 7, a gaming system includes a main board that runs 710 the primary gaming software and operating system. A secondary or back-up board provides 712 an error recovery system that can be run 714 when a fault condition or exception is detected from the main board or software executing on the main board. The secondary board may include a processor and software executing continuously on the processor to monitor the error condition of the main board, and in the event of detecting an error, take over for the main board in order to provide a back-up mode of operation or to provide a graceful shutdown or suspension of game play, for example preserving the credits and any awards or jackpots that were won by the player just prior to the fault or error condition being detected. The secondary board may, for example, lock up the main board and display data that can be used to diagnose the error on the main board. Or, the secondary board or error monitoring software on the main board may run a continuous statistical analysis of a top list of process thresholds, and include a check to see if processes match a predetermined expected list of processes that are expected to be running, and whether or not memory is overloaded. If an error is detected, the monitoring software may require the game to cash out or lock up, and possibly take some remedial action. According to another embodiment, the foregoing concepts of (detection/recovery) can be applied to server-based evaluation gaming machine models also.

Figure 8:
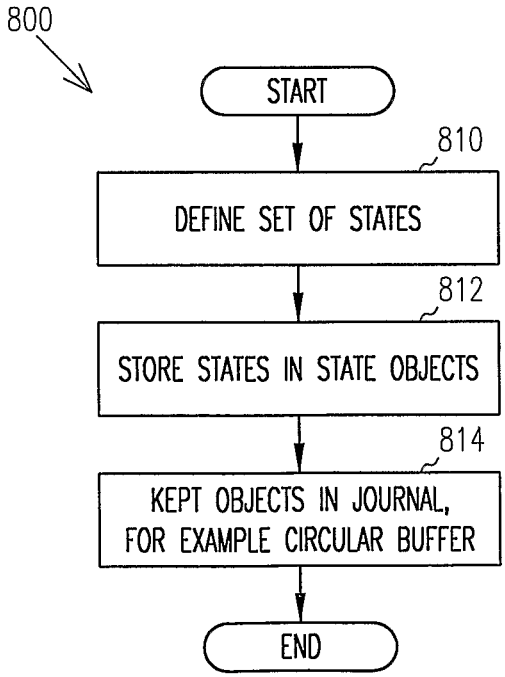

According to still another example embodiment 800 shown in FIG. 8, a method provides for serializing the machine state of a gaming machine for each process and serializing the states in a second location. For example, the system may provide for defining a set of states and the data needed to reload that states, which may be stored 812 in a state object. Snapshots of those states may be taken periodically and kept 814 in a journal that may be recorded locally in the gaming machine or on a server in communication with the gaming machine. In one embodiment, the system may save every state or change in data in the gaming machine, or only just calculations most recently performed or only just selected data. These states or data may be pushed to a host system, such as the server, and kept, for example in a circular buffer. According to another embodiment, the system may store the beginning state and a memory dump that has everything that is not in the hardware, and optionally the hardware states may also be recorded. The physical memory may be dumped, and using the kernel all operations or processes can be stopped from going forward and the dump may occur once these processes are stopped. According to another embodiment, the system provides for a core dump of memory before a crash results in the corruption of the data stored in the memory, so that the system can determine what memory looked like before it crashed. In the event there is a core dump before a crash it is possible to determine which processes have fault conditions. In one embodiment, the fault condition is caused by a component failure or corruption. According to still another embodiment, the memory dump is triggered upon initial detection of a fault condition, preferably prior to the corruption of memory.

According to still another example embodiment, the method and system provides for journaling the running processes, i.e., tracking them while they run. Journaling may also include journaling data and program states, and not just be limited to processes.

In one embodiment a core dump in an operating system dumps with time, such as a circular journal with snapshots. In another embodiment, where a core dump reveals where a program is loaded, a host system may tunnel into the gaming machine, launch a GBDserver program (GNU Project debugger) and capture as much information as possible. According to one example embodiment, a GDBSERVER is a program that allows you to run GDB on a different machine than the one which is running the program being debugged. For example when a fault is detected the GBD program may be launched before the associated process is dead so a remote GBD can monitor the process. If, for instance, the kernel knows a core dump is coming, it can launch the GBDserver on the process that is about to core dump (i.e. crashed process), and push the core dump out to a server. According to another example embodiment, there may be provided read-writable flash or hard drive to which a core dump can be made. In another embodiment, there are provided secure GBDserver operations with journals and logs such as event logs.

Figure 9:
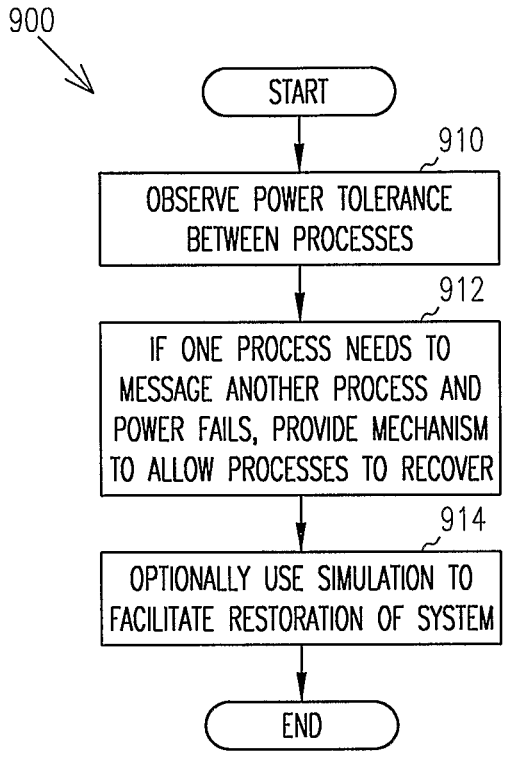

According to another embodiment 900 shown in FIG. 9, the system and method according to the inventive subject matter may observe power tolerance between processes, such as, for instance, if process A needs to message process B and power fails, a mechanism 912 is provided to allow A and B to recover. In one embodiment, a state variable may be marked across machines or processes. According to still another embodiment, there is provided 914 a master software simulator that follows machine operation and allows restoration of a failed machine. Such a simulator may mirror machine operation to assist in a restore operation.

Fast Boot Embodiments

According to still other example embodiments, there are provided method and apparatus to increase boot speed. While one way to increase boot speed is to use one or more of the above fault tolerance mechanisms to provide a known, non-fault state to fall back on, so that a gaming machine may improve its boot speed by starting immediately from the recovered state, instead of performing the complete boot sequence. It is noted, however, that the feature of increasing boot speed described herein below does not require the fault tolerant design features described above.

Figure 10:
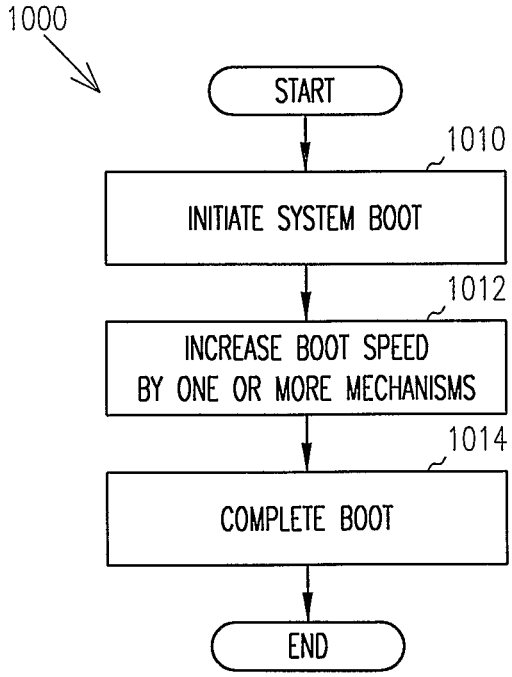

According to still another example embodiment 1000 shown in FIG. 10, there is provided a method and system for increasing the speed of a system boot, for instance to recover from an error condition, or simply to start a gaming machine following maintenance or a software update. According to this embodiment, a boot is initiated 1010. But speed may be increased 1012 or made less annoying by applying one or more of the following techniques alone or in combination: a) increasing the speed at which data and software can be loaded from the media (such as ROM); b) keeping the kernel of the system "always on" so that it does not have to be reloaded in the boot process; c) store art and sound files on a faster media, such as faster flash memory; d) playing a movie or video segment during the boot process; d) starting game play prior to completion of loading of all sound or graphic or other files, by first loading only the files needed to initiate game play but not all files needed for all modes of game play; e) modifying memory so that at least some portion of it is non-executable until such time as the contents of it have been validated, thus allowing game play to begin prior to verification of the entire gaming program; f) separate processors for critical data as opposed to graphics that don't need to be executed, thus allowing splitting of media loading, such that loads from slow media do not inhibit the initiation of game play; g) aggregate multiple files into a single file so that there are fewer files to be validated, and thus allow for less time to boot than when multiple files need to be validated; h) verifying and validating files from RAM as opposed to while in flash; i) provide an embedded chip in the system to calculate and process keys and signatures; j) do random sampling of files to validate as opposed to full verification, for example a statistical validation; or k) allowing the bios to act as a ftp server and client and calculate/verify the files as it pulls the data through to the machine. By one or more of these mechanisms the boot is completed 1014.

In this description, numerous specific details are set forth. However, it is understood that embodiments of the invention may be practiced without these specific details. In other instances, well-known circuits, structures and techniques have not been shown in detail in order not to obscure the understanding of this description. Note that in this description, references to "one embodiment" or "an embodiment" mean that the feature being referred to is included in at least one embodiment of the invention. Further, separate references to "one embodiment" in this description do not necessarily refer to the same embodiment; however, neither are such embodiments mutually exclusive, unless so stated and except as will be readily apparent to those of ordinary skill in the art. Thus, the present invention can include any variety of combinations and/or integrations of the embodiments described herein. Each claim, as may be amended, constitutes an embodiment of the invention, incorporated by reference into the detailed description. Moreover, in this description, the phrase "exemplary embodiment" means that the embodiment being referred to serves as an example or illustration.

Further, block diagrams illustrate exemplary embodiments of the invention. Also herein, flow diagrams illustrate operations of the exemplary embodiments of the invention. The operations of the flow diagrams are described with reference to the exemplary embodiments shown in the block diagrams. However, it should be understood that the operations of the flow diagrams could be performed by embodiments of the invention other than those discussed with reference to the block diagrams, and embodiments discussed with references to the block diagrams could perform operations different than those discussed with reference to the flow diagrams. Additionally, some embodiments may not perform all the operations shown in a flow diagram. Moreover, it should be understood that although the flow diagrams depict serial operations, certain embodiments could perform certain of those operations in parallel.

The invention claimed is:

1. A gaming system comprising:

a computing platform including one or more processors;

a software program executing on a primary board of the computing platform to provide a gaming experience to a user of the gaming system;

one or more fault detection components operative on the computing platform to detect faults occurring on the platform, the one or more fault detection components comprising at least one of a hardware component or a software component; and at least one fault recovery software component operative to execute on a secondary board of the computing platform;

wherein the computing platform, in the absence of a detected fault, receives a request to execute a calculation on a received data set and, in response to results of the calculation meeting certain criteria, the one or more fault detection components causes the at least one fault recovery software component to execute on the secondary board of the computing platform.

2. The gaming system of claim 1, wherein the results meeting certain criteria indicates a hardware fault.

3. The gaming system of claim 1, wherein the results meeting certain criteria indicates a fault on the primary board of the gaming machine.

4. The gaming system of claim 1, wherein the at least one fault recovery software component causes the gaming system to save one or more states of the gaming system and then restart the gaming system to an error-free condition.

5. The gaming system of claim 4, wherein the one or more states represent at least one probable stable configuration, and wherein the one or more states are stored in a nonvolatile storage device.

6. The gaming system of claim 4, wherein restarting the gaming system to an error-free condition includes restoring the last known stable configuration stored in a memory device.

7. The gaming system of claim 1, wherein the at least one fault recovery software component, when executed, causes the computing platform to halt or restrict operation of the gaming system.

8. The gaming system of claim 1, wherein the request and the received data are received from a server connected to a network.

9. The gaming system of claim 1, wherein the request and the received data are received from a server connected to a network, and the results of the calculation are transmitted to a server connected to a network for comparing to the certain criteria.

10. A method of operating a gaming system to conduct a wagering game, the gaming system including a computing platform with a primary board and a secondary board, and one or more fault detection components operative on the computer platform to detect faults occurring on the computing platform, the method comprising:

executing a software program on the primary board to present the wagering game to a user;

receiving, at the computing platform and in the absence of a detected fault, an electronic request to execute a calculation on a received data set;

in response to results of the calculation meeting certain criteria, the one or more fault detection components causing a fault recovery software component to execute on the secondary board.

11. The method of claim 10, wherein, in response to the results of the calculation meeting certain criteria, the method further comprises initializing a boot procedure and increasing the speed of the boot procedure by causing the computing platform to load during the boot procedure only those graphics or sound files that are required to initiate play of the wagering game.

12. The method of claim 10, wherein executing the fault recovery software component causes the gaming system to initialize a boot procedure, causes the computing platform to verify the authenticity of only those files that are required to initiate play of the wagering game, causes the computer platform to initiate the play of the game, and causes the computer platform to verify the authenticity of additional files after the play of the game has been initiated.

13. The method of claim 10, wherein the results of the calculation meeting certain criteria indicates a fault on the primary board of the gaming system.

14. The method of claim 10, further comprising continuously receiving the request to execute the calculation and repeatedly determining if the results of the calculation meet the certain criteria.

15. A gaming machine configured to play a wagering game, the gaming machine comprising:

a computing platform including one or more processors, a primary board, and a secondary board;

a software program operative to execute on the primary board to provide the wagering game to a user;

one or more fault detection components operative on the computing platform to detect faults occurring on the computing platform, the one or more fault detection components comprising at least one of a hardware component or a software component; and at least one fault recovery software component operative to execute on the secondary board;

wherein the computing platform, in the absence of a detected fault, receives a request to:

execute a calculation on a received data set, and in response to results of the calculation meeting certain criteria, causes, via the one or more fault detection components, the at least one fault recovery software component to execute on the secondary board.

16. The gaming machine of claim 15, wherein executing the at least one fault recovery software component includes saving a state of the gaming machine and restarting the gaming machine in an error-free condition.

17. The gaming machine of claim 16, wherein a state of the gaming machine in the error-free condition is different from the saved state of the gaming machine.

18. The gaming machine of claim 15, wherein the request and the received data set are received from a server connected to a network.

19. The gaming machine of claim 15, wherein the computing platform further causes the results of the calculation to be transmitted to a server connected to a network for comparing to the certain criteria.

20. The gaming machine of claim 15, wherein, the at least one fault recovery software component includes a self-diagnostic check.

21. The gaming machine of claim 15, wherein the results meeting the certain criteria indicates a fault on the primary board of the gaming machine.

* * * * *